US006249081B1

(12) United States Patent
Rossi

(10) Patent No.: US 6,249,081 B1
(45) Date of Patent: Jun. 19, 2001

(54) LOW CHROMIUM FERRITIC STAINLESS STEEL STUDS FOR CATHODE RAY TUBES

(75) Inventor: Juan J. Rossi, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/338,406

(22) Filed: Jun. 22, 1999

Related U.S. Application Data

(60) Provisional application No. 60/128,978, filed on Apr. 12, 1999.

(51) Int. Cl.[7] ..... H01J 29/80
(52) U.S. Cl. ..... 313/406; 313/402
(58) Field of Search ..... 313/402, 406

(56) References Cited

U.S. PATENT DOCUMENTS

| | | | | |
|---|---|---|---|---|
| 3,379,913 | | 4/1968 | Gannoe | 313/85 |
| 4,755,713 | | 7/1988 | Wageaknecht et al. | 313/406 |
| 4,886,997 | * | 12/1989 | Inoue et al. | 313/406 |

* cited by examiner

*Primary Examiner*—Vip Patel
(74) *Attorney, Agent, or Firm*—William H. McNeill

(57) ABSTRACT

A cathode ray tube face panel having an upstanding wall therearound with a plurality of article supporting studs retained therein, said studs being formed from an alloy having a chromium content of from about 10 to 16% by weight and the balance iron.

3 Claims, 1 Drawing Sheet

LOW CHROMIUM FERRITIC STAINLESS STEEL STUDS FOR CATHODE RAY TUBES

This application claims priority from Provisional Application No. 60/128,978, filed Apr. 12, 1999.

TECHNICAL FIELD

This invention relates to cathode ray tubes and more particularly to face panels therefore having article supporting studs retained therein. Still more particularly, it relates to the studs themselves.

BACKGROUND ART

In certain types of cathode ray tubes, particularly those adapted to provide color imagery, it is conventional to position specialized structures, such as grids or apertured shadow masks, in the proximity of the cathodoluminescent screen. These structures generally are supported within the face panel on a plurality of supporting studs embedded in the wall of the face panel. The studs, which are heated for sealing into the wall, are of an alloy having a thermal coefficient of expansion that is compatible with the glass. The usual form of the studs is a hollow body having a head for receiving a support spring and a skirt for insertion into the glass wall of the face panel. In past practice, these studs have been manufactured from an iron alloy comprised of 18 to 26 weight percent chromium and the balance iron (ASTM F256) and, more specifically, an 18 to 20 weight percent chromium-iron alloy (430TiM) stabilized with 0.2 to 0.6 weight percent titanium. Other iron-based alloys that have been used for glass to metal sealing in such face panels have included chromium-free nickel alloys and chromium-nickel-iron alloys such as ASTM F31. These alloys are expensive.

DISCLOSURE OF INVENTION

It is, therefore, an object of the invention to obviate the disadvantages of the prior art.

It is another object of the invention to provide a low cost stud that is suitable for metal sealing in cathode ray tube face panels.

These objects are accomplished, in one aspect of the invention, by providing a cathode ray tube face panel having an upstanding wall therearound with a plurality of article supporting studs retained therein, said studs being formed from an alloy having a chromium content of from about 10 to 16% by weight and the balance iron.

In a preferred embodiment of the invention, the stud has a chromium content of 12 to 14%.

These studs are compatible with the glass of the cathode ray tube face panel and are workable and less expensive than those previously employed.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
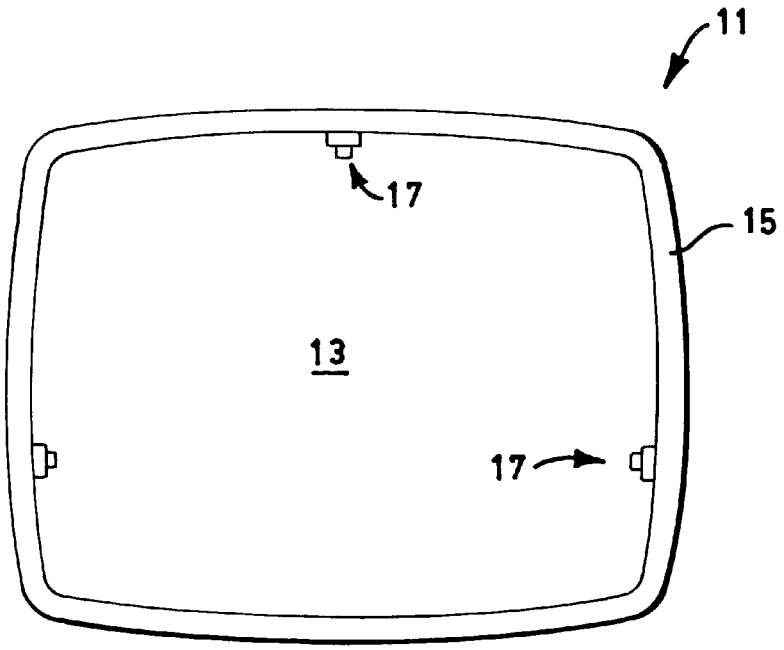
FIG. 1 is a plan view of a first type of cathode ray tube face panel in accordance with an aspect of the invention.

Referring now to the drawings with greater particularity, there is shown in FIG. 1 a face panel 11 having a face 13 surrounded by an upstanding wall 15. Positioned about the wall 15 and inserted therein are studs 17. In accordance with an aspect of the invention, the studs 17 are fabricated from an alloy comprised of less than 18 weight percent chromium and the balance iron. In a preferred embodiment, the studs comprise from 10 to 16 weight percent chromium and in a more preferred embodiment, the studs comprise 12 to 14 weight percent chromium. In a still ore preferred embodiment the studs comprise 11% by weight of chromium. These studs, when properly stabilized, as by the addition of 0.2 to 0.6 weight percent titanium, can be successfully oxidized and sealed to panel glasses.

Figure 2:
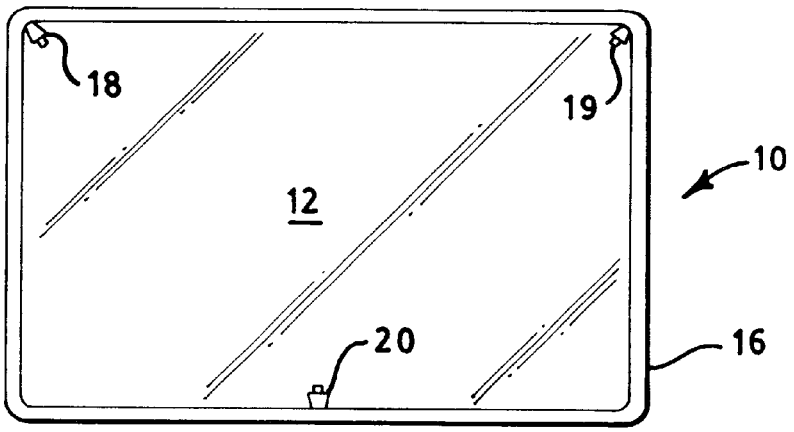
FIG. 2 is a similar view of an alternate aspect of the invention.

In FIG. 2 is shown a newer, more rectangular face panel 10 having an upstanding wall 16 with studs 18, 19, and 20 inserted therein. In this particular instance, studs 18 and 19 are inserted into the corners of the face panel. The studs 17 and the studs 18, 19, and 20 may have different configurations as is known in the art. See, for example, U.S. Pat. Nos. 3,379,913 and 4,755,713, both of which are owned by the assignee of the present invention.

While there have been shown and described what are at present considered the preferred embodiments of the invention, it will be apparent to those skilled in the art that various changes and modifications can be made herein without departing from the scope of the invention as defined by the appended claims.

What is claimed is:

1. A cathode ray tube face panel having an upstanding wall therearound with a plurality of article supporting studs retained therein, said studs being formed from an alloy having a chromium content of from about 10 to 16% by weight and the balance iron.

2. The cathode ray tube face panel of claim 1 wherein said alloy has a chromium content of 12 to 14% by weight.

3. The cathode ray tube face panel of claim 1 wherein said alloy has a chromium content of 11% by weight.

* * * * *